United States Patent [19]

Kajiwara et al.

[11] Patent Number: 4,537,057

[45] Date of Patent: Aug. 27, 1985

[54] METHOD FOR RD ROLLING SHEET METAL

[75] Inventors: Toshiyuki Kajiwara; Tatsuji Kojima, both of Hitachi, Japan

[73] Assignee: Hitachi, Ltd., Tokyo, Japan

[21] Appl. No.: 473,197

[22] Filed: Mar. 8, 1983

[30] Foreign Application Priority Data

Mar. 10, 1982 [JP] Japan ..... 57-38802

[51] Int. Cl.[3] ..... B21B 29/00; B21B 31/18; B21B 31/20

[52] U.S. Cl. ..... 72/243; 72/247

[58] Field of Search ..... 72/243, 247, 11, 8, 72/17, 365, 366

[56] References Cited

U.S. PATENT DOCUMENTS

| | | | |
|---|---|---|---|
| 3,709,017 | 1/1973 | Vydrin et al. | 72/205 |
| 3,902,345 | 9/1975 | Shida | 72/8 |
| 4,194,382 | 3/1980 | Kajiwara | 72/243 |
| 4,311,030 | 1/1982 | Kitashima et al. | 72/8 |
| 4,365,496 | 12/1982 | Shiozaki | 72/8 |
| 4,369,646 | 1/1983 | Kajiwara | 72/247 |
| 4,400,957 | 8/1983 | Carlstedt et al. | 72/8 |

*Primary Examiner*—E. Michael Combs
*Attorney, Agent, or Firm*—Beall Law Offices

[57] ABSTRACT

A rolling mill comprises a pair of an upper and a lower work roll having a small diameter which is as large as about 0.15 to 0.30 times the width of a metal sheet article to be rolled, a pair of an upper and a lower back-up roll, a pair of an upper and a lower intermediate roll disposed intermediate between the work roll pair and the back-up roll pair, work roll bending units and intermediate roll bending units imparting bending forces to the roll ends of the upper and lower work rolls and/or the roll ends of the upper and lower intermediate rolls respectively, roll shifting units capable of shifting the upper and lower intermediate rolls in axial directions opposite to each other, and drive units coupled to the associated ends of the upper and lower intermediate rolls to rotate the upper and lower work rolls at different peripheral speeds through the intermediate rolls. The directions of roll bending by the work roll bending units and/or the intermediate roll bending units and the relative movement of the body ends of the intermediate rolls relative to the widthwise ends of the sheet article caused by the roll shifting units are controlled thereby forming slight edge waves in the widthwise edge regions of the sheet article, so that, even when a high tension is applied to the sheet article during rolling with a high reduction ratio, occurrence of cracks in the widthwise ends of the sheet article is minimized to prevent breakage of the sheet article.

7 Claims, 20 Drawing Figures

FIG. 12

| SHAPE PATTERN | A | B | C | D |
|---|---|---|---|---|
| SHEET SHAPE: WIDTHWISE SURFACE PROFILE | SHEET SURFACE, SHEET WIDTH | | | |
| SHEET SHAPE: LONGITUDINAL VIEW | f | f | f | f |
| SHAPE APPEARANCE | ○ | × | × | ○ |
| BREAKAGE RESISTANCE | ○ | ○ | × | × |
| WORK ROLL DIAMETER | SMALL | LARGE | LARGE | LARGE |
| INTERMEDIATE ROLL SHIFT | WITH SHIFT | WITHOUT SHIFT | WITHOUT SHIFT | WITH SHIFT |

METHOD FOR RD ROLLING SHEET METAL

This invention relates to a rolling mill including work rolls driven at different peripheral speeds.

A rolling mill utilizing the so-called RD (rolling drawing) effect as disclosed in U.S. Pat. No. 3,709,017 is known as a type of rolling mill including work rolls driven at different peripheral speeds.

In the disclosed rolling mill utilizing the RD effect, an upper work roll and a lower work roll are driven at different peripheral speeds, and the neutral point N between the peripheral speed of one of the work rolls and the moving speed of a metal sheet article being rolled is displaced from the neutral point with respect to the other work roll. More precisely, the point $N_1$, at which the peripheral speed $v_1$ of the upper work roll driven at a higher speed is equal to the delivery speed $v_{S2}$ of the sheet article, and the point $N_2$, at which the peripheral speed $v_2$ of the lower work roll driven at a lower speed is equal to the entry speed $v_{S1}$ of the sheet article, are displaced relative to each other, so that the forces of friction $\tau$ acting upon the sheet article are oppositely directed throughout the arcuate contact areas where the angles of nip of the upper and lower work rolls are $\theta$. Because of the above arrangement, the metal sheet article being rolled is not compressed in the horizontal direction (the moving direction of the article), and the rolling pressure is not affected by the forces of friction. The rolling pressure can therefore be greatly reduced to permit rolling of very thin metal strips which can not be rolled with conventional rolling mills. Thus, the disclosed rolling mill is suitable for rolling of hard and thin metal sheet articles. However, on the other hand, the disclosed rolling mill utilizing the RD effect has two great defects as pointed out below, and, therefore, difficulty will be encountered for attainment of stable rolling operation. The two great defects are as follows:

(1) The risk of breakage of a metal sheet article being rolled is very high.

(2) Chattering tends to occur.

Consider now the so-called perfect RD rolling, in which the neutral-point angle $\phi_2$ defined between the neutral point $N_2$ of the lower-speed work roll and the center line connecting both centers of the work rolls is $\phi_2=\theta$, while the neutral-point angle $\phi_1$ defined between the neutral point $N_1$ of the higher-speed work roll and the center line is $\phi_1=0$. In such a case, the entire rolling energy is given only by the difference between the tensions applied to the delivery and entry sides of the sheet article being rolled, and the positive and negative energies supplied by the work rolls are consumed for work in slippage between the work rolls and the sheet article. Therefore, the energy for causing plastic deformation of the sheet article is given by the difference between the tensions applied to the delivery and entry sides of the sheet article, and the tension difference $\Delta\sigma$ required in this case is given by the following equation:

$$\Delta\sigma=\sigma_f-\sigma_b=S\cdot ln1/(1-Y)$$

where $\sigma_f$: tension applied to the delivery side of the sheet article (kg/mm$^2$)

$\sigma_b$: tension applied to the entry side of the sheet article (kg/mm$^2$)

S: average deformation resistance of the sheet article (kg/mm$^2$)

$\gamma$: reduction ratio ln: mathematical symbol for natural logarithm

Suppose, for example, rolling of a low-carbon steel containing 0.08% of carbon. Then, the value of $\sigma_f$ increases greatly with the increase in the reduction ratio $\gamma$ as shown in FIG. 2.

However, the value of $\sigma_f$ is commonly limited to the range of 10 kg/mm$^2$ to 20 kg/mm$^2$ relative to the reduction ratio range of 20% to 40% from the aspect of the factor of safety against possible breakage of metal sheet articles. Thus, although a high reduction ratio is desired, this reduction ratio is inevitably limited to a small value because such a high reduction rolling is generally impossible due to breakage of metal sheet articles. With such a low reduction ratio, the RD effect permitting rolling under a low rolling pressure can not be fully exhibited. Further, breakage of a metal sheet article results from the fact that the tension applied to the delivery side of the sheet article has an excessively large value which creates cracks in the widthwise edge portions of the sheet article. It has therefore been strongly demanded to realize a rolling mill which can fully utilize the RD effect and yet can roll a metal sheet article without giving rise to breakage of the sheet article.

According to the method of rolling utilizing the RD effect, the high-speed and low-speed work rolls are so controlled that the relations $\phi_1=0$ and $\phi_2=\theta$ are satisfied at the neutral points $N_1$ and $N_2$ respectively. The relations $\phi_1=0$ and $\phi_2=\theta$ must hold for the full exhibition of the RD effect because chattering occurs when the angle $\phi_1$ is $\phi_1<0$ meaning that the neutral point $N_1$ is shifted toward the delivery side beyond the bite of the work rolls. To this end, the positions of these two neutral points $N_1$ and $N_2$ must be accurately controlled. Even in the normal rolling process with work rolls driven at the same speed where $\phi_1=\phi_2$, it is required, when rolling under high reduction, to pay careful attention to the control of roll coolant and to the rolling conditions for achieving stable rolling works, since high reduction has a tendency to invite chattering, although the normal rolling is generally considered to be stable. The RD rolling is more critical in stability because the rolling conditions are shifted toward the unstable side and the rolling is effected at critical conditions. Therefore, it is difficult to satisfactorily effect the RD rolling as maintaining the neutral points $N_1$ and $N_2$ accurately at the desired positions by using a conventional speed control.

It is therefore an object of the present invention to provide a rolling mill for rolling a metal sheet article between work rolls driven at different peripheral speeds, which can roll the sheet article with a high reduction ratio under application of a low rolling pressure while preventing occurrence of breakage of the sheet article.

Another object of the present invention is to provide a rolling mill for rolling a metal sheet article between work rolls driven at different peripheral speeds, which rolls the sheet article so as to produce slight edge waves at the widthwise edge portions of the sheet article without impairing the shape of the widthwise middle portion of the sheet article, so that breakage of the sheet article is prevented even when a large tension is imparted to the sheet article.

In accordance with the present invention, there is provided a rolling mill comprising a pair of upper and lower work rolls of small diameter, a pair of upper and lower back-up rolls, a pair of upper and lower intermediate rolls disposed intermediate between each of the upper and lower work rolls and an associated one of the upper and lower back-up rolls, roll bending means for imparting a bending force to the roll ends of at least one of the work roll pair and the intermediate roll pair, roll shifting means for shifting the upper and lower intermediate rolls in their axial direction, drive means for rotating the upper and lower work rolls at different peripheral speeds, and control means for controlling the roll bending means and the roll shifting means so as to form slight edge waves in the widthwise edge portions of a sheet article rolled between the upper and lower work rolls, whereby the sheet article is rolled with a high reduction ratio while prevented breakage.

The above and other objects, features and advantages of the present invention will become apparent from the following detailed description of preferred embodiments thereof taken in conjunction with the accompanying drawings, in which.

Figure 10:
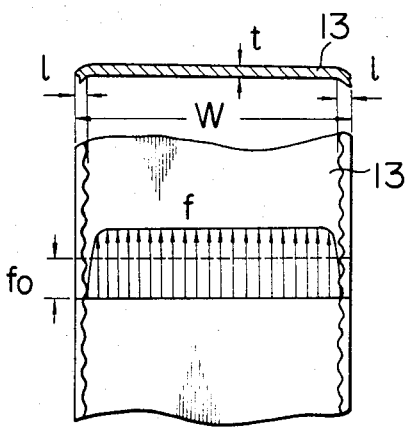
Figure 11:
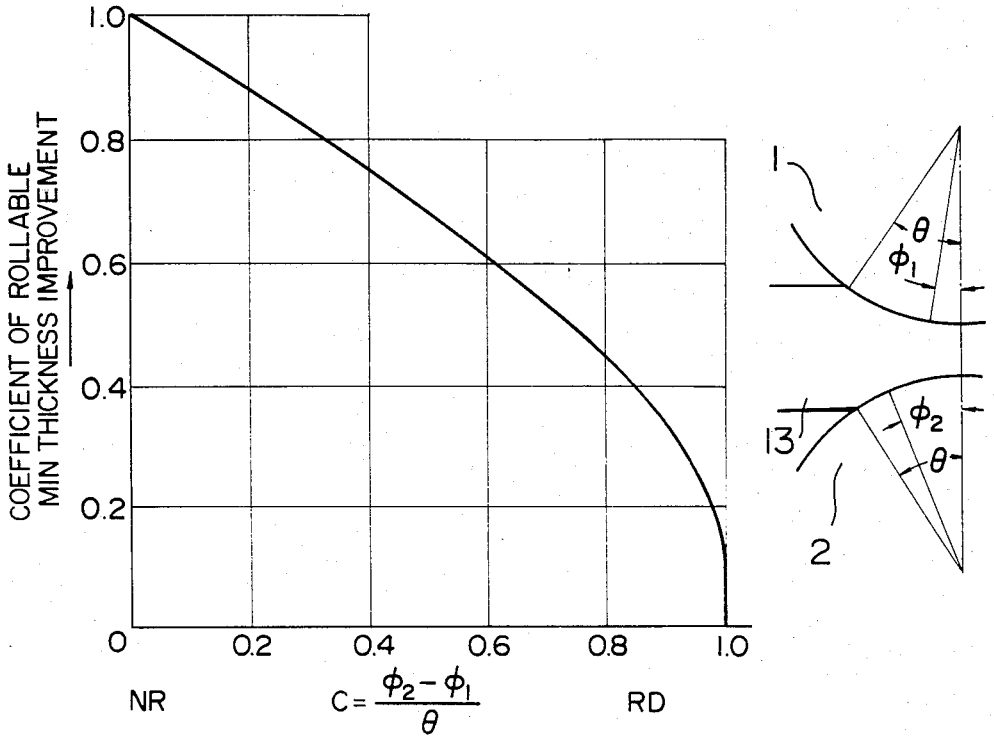
Figure 13A:
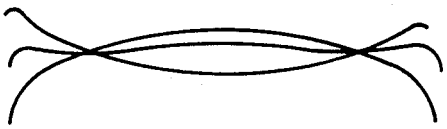
Figure 13B:
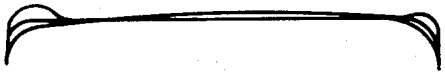

FIGS. 8*a* to 8*d* illustrate various modes of rolling by the rolling mill according to the present invention respectively;

FIGS. 9*a* to 9*d* illustrate various resultant sectional shapes of a metal sheet article rolled under the modes shown in FIGS. 8*a* to 8*d* respectively;

FIG. 10 illustrates diagrammatically the distribution of the tension imparted to a metal sheet article rolled by the rolling mill to which the present invention is applied;

FIG. 11 illustrates the coefficient of improvement $\alpha$ indicating how the rollable minimum sheet thickness of metal sheet articles can be reduced by rolling utilizing the RD effect;

FIG. 12 is a comparative table illustrating how the final shape pattern of a metal sheet article rolled by the rolling mill embodying the present invention is superior to those of metal sheet articles rolled by conventional rolling mills; and FIGS. 13*a* and 13*b* show the surface profiles of metal sheet articles rolled by a conventional rolling mill and the rolling mill embodying the present invention respectively to compare the effect of the diameter of the work rolls on the results of rolling.

A preferred embodiment of the present invention, when applied to a six-high rolling mill including work rolls driven at different peripheral speeds, will now be described in detail with reference to the drawings.

Figure 1:
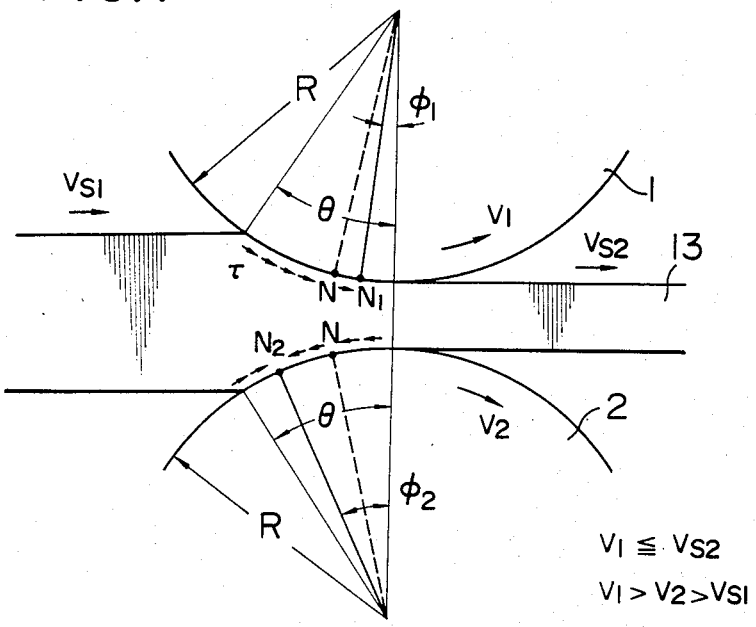
FIG. 1 illustrates the basic principle of rolling utilizing the RD effect.

FIG. 1 illustrates the basic principle of rolling utilizing the RD effect. Referring to FIG. 1, the peripheral speed $v_1$ of a high-speed work roll 1 is equal to the speed $v_{S2}$ of the delivery portion of a metal sheet article 13 at the point $N_1$, and the peripheral speed $v_2$ of a low-speed work roll 2 is equal to the speed $v_{S1}$ of the entry portion of the metal sheet article 13 at the point $N_2$, as described already. These points $N_1$ and $N_2$ are displaced relative to each other so that the forces of friction $\tau$ acting upon the article 13 are oppositely directed throughout the articuate contact areas where the upper and lower work rolls 1 and 2 bite the sheet article 13 at the entry angles $\theta$. Because of the above arrangement, the rolling pressure applied by the work rolls 1 and 2 is not affected by the friction forces $\tau$ and can therefore be greatly reduced so that rolling with a high reduction ratio can be stably achieved.

The structure of the rolling mill of the present invention adapted for rolling utilizing the RD effect will be described in detail with reference to FIGS. 3, 4 and 5.

Figure 3:
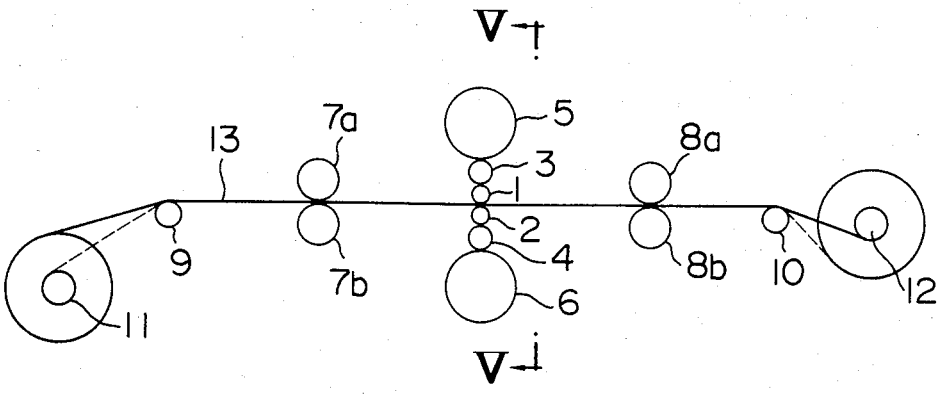
FIG. 3 is a schematic general view of a rolling mill arrangement to which the present invention is applied.
Figure 5:
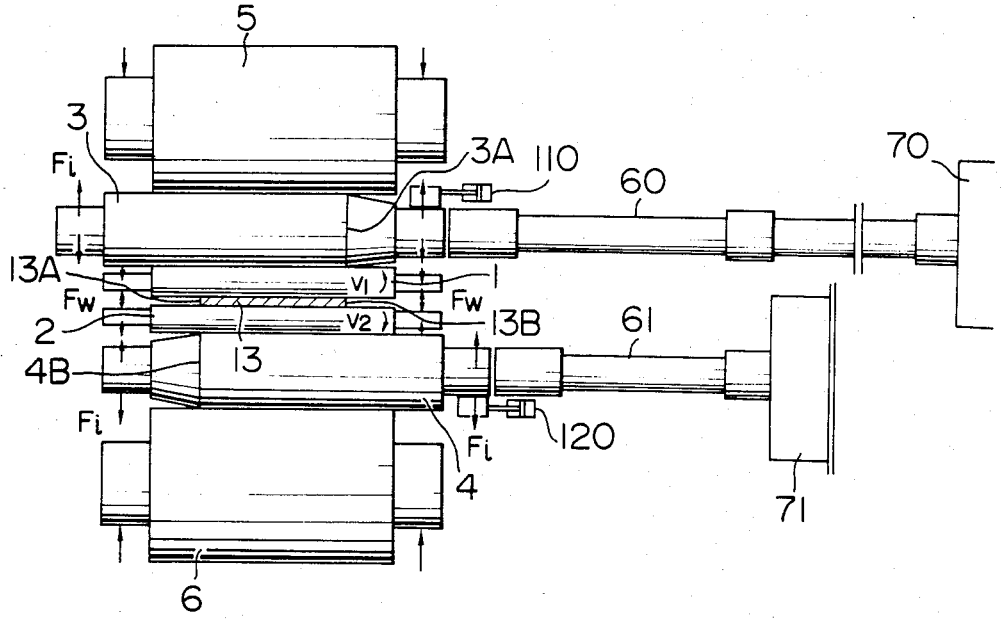
FIG. 5 is a side elevation view of the rolling mill when viewed along the line V—V in FIG. 3.
Figure 4:
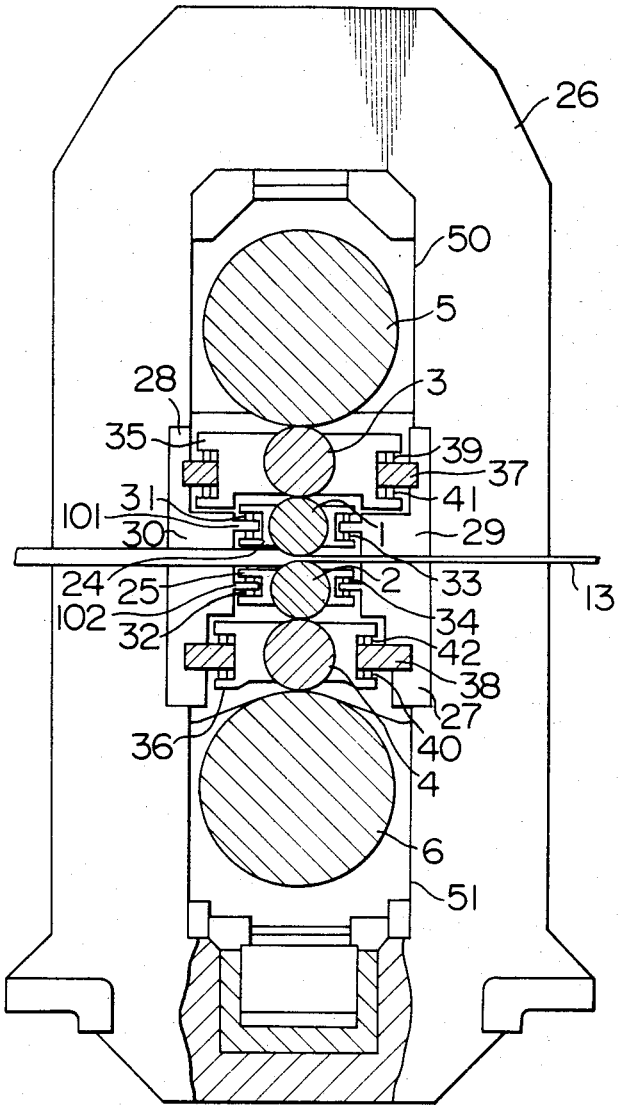
FIG. 4 is a front elevation view of an embodiment of the rolling mill according to the present invention.

Referring to FIGS. 3, 4 and 5, the rolling mill includes a pair of an upper work roll 1 and a lower work roll 2 of small diameter for rolling a metal sheet article 13 therebetween. The work rolls 1 and 2 are journalled at their ends in metal chocks 24 and 25 respectively. The metal chocks 24 and 25 are disposed so as to be vertically movable inside of projecting portions 29 and 30 of project blocks 27 and 28 mounted opposite to each other to project into the opening of a roll housing 26 respectively. These projecting portions 29 and 30 are formed with upper lugs 101 and lower lugs 102 respectively. Hydraulic rams 31 and 32 for imparting roll bending forces to the ends of the work rolls 1 and 2 to urge the roll ends away from each other, and hydraulic rams 33 and 34 for imparting roll bending forces to the ends of the work rolls 1 and 2 to urge the roll ends toward each other, are installed in the upper and lower lugs 101 and 102 respectively.

The diameter of the upper and lower work rolls 1 and 2 employed in the embodiment of the rolling mill according to the present invention is preferably sufficiently small so that the roll bending effect can produce slight edge waves in the widthwise edge portions only of the sheet article 13 without impairing the shape of the widthwise middle portion of the sheet article 13.

More concretely, it is preferable that the following relation holds between the diameter $D_W$ of the upper and lower work rolls 1, 2 and the width W of the metal sheet article 13:

$$0.15W \leqq D_W \leqq 0.30W$$

This relation is essentially required because, when the work roll diameter $D_W$ is larger than 0.30 W, the roll bending effect will be exerted not only on the widthwise edge portions but also on the widthwise middle portion of the metal sheet article 13 due to the excessively large rigidity of the work rolls, resulting in impairment of the shape of the rolled article 13. Also, when the work roll diameter $D_W$ is smaller than 0.15 W, the work rolls 1 and 2 will be deflected in the horizontal direction by the tangential forces imparted in the horizontal direction from rolls, for example, an upper intermediate roll 3 and a lower intermediate roll 4 transmitting the drive forces driving the work rolls 1 and 2, resulting in impossibility of satisfactory rolling.

The upper and lower intermediate rolls 3 and 4 are disposed in pair directly above and beneath the upper and lower work rolls 1 and 2 respectively. These intermediate rolls 3 and 4 are journalled at their ends in metal chocks 35 and 36 respectively. These metal chocks 35 and 36 are removably engaged by roll shifting units 110 and 120 respectively shown in FIG. 5 so as to be shifted relative to each other in their axial direction. Further, these metal chocks 35 and 36 are disposed so as to be also vertically movable inside of blocks 37 and 38 carried by the project blocks 27 and 28 respectively. Hydraulic rams 39 and 40 for imparting roll bending forces to the ends of the intermediate rolls 3 and 4 to urge the roll ends away from each other, and hydraulic rams 41 and 42 for imparting roll bending forces to the ends of the rolls 3 and 4 to urge the roll ends toward each other, are installed in the blocks 37 and 38 respectively. As described in detail later, drive spindles 60 and 61 are connected to the intermediate rolls 3 and 4 and are driven by drive motors 70 and 71 respectively as shown in FIG. 5, so that the upper and lower work rolls 1 and 2 can be driven at different peripheral speeds through the upper and lower intermediate rolls 3 and 4 respectively. The upper and lower intermediate rolls 3 and 4 have a diameter larger than that of the upper and lower work rolls 1 and 2, and the roll bending forces bending the ends of the intermediate rolls 3 and 4 are larger than those bending the ends of the work rolls 1 and 2. Backup rolls 5 and 6 support the intermediate rolls 3 and 4 respectively. These back-up rolls 5 and 6 are larger in diameter and higher in rigidity than the intermediate rolls 3 and 4. Metal chocks 50 and 51 shown in FIG. 4 support the ends of the back-up rolls 5 and 6 respectively and are disposed so as to be vertically movable inside of the roll housing 26.

Referring to FIG. 3, a two-high rolling mill composed of a pair of rolls *7a, 7b* and another two-high rolling mill composed of a pair of rolls *8a, 8b* are disposed on both sides of the six-high rolling mill to act also as skin pass mills. These mills function as a device for imparting a tension to the metal sheet article 13 when the sheet article 13 is to be rolled with a high reduction ratio. Deflect rolls 9 and 10 are provided to guide the metal sheet article 13 supplied from a supply reel 11 and taken up by a winding reel 12.

The drive units for driving the upper and lower work rolls 1 and 2 of small diameter are preferably disposed adjacent to the roll ends of the back-up rolls 5, 6 or intermediate rolls 3, 4. Considering the equipment costs or inter-roll slippage, it is more preferable to connect the roll drive units to the roll ends of the intermediate rolls 3 and 4. When the drive units are thus disposed to indirectly drive the work rolls 1 and 2 though the intermediate rolls 3 and 4, there is a possibility of slippage between the work rolls and the intermediate rolls. Occurrence of such slippage can be prevented by controlling the torque of the roll drive units, since this is conveniently attained. Thus, the torque of the drive units driving the intermediate rolls 3 and 4 is controlled so as to satisfy the following relation:

$$T<\mu P$$

where

Figure 6:
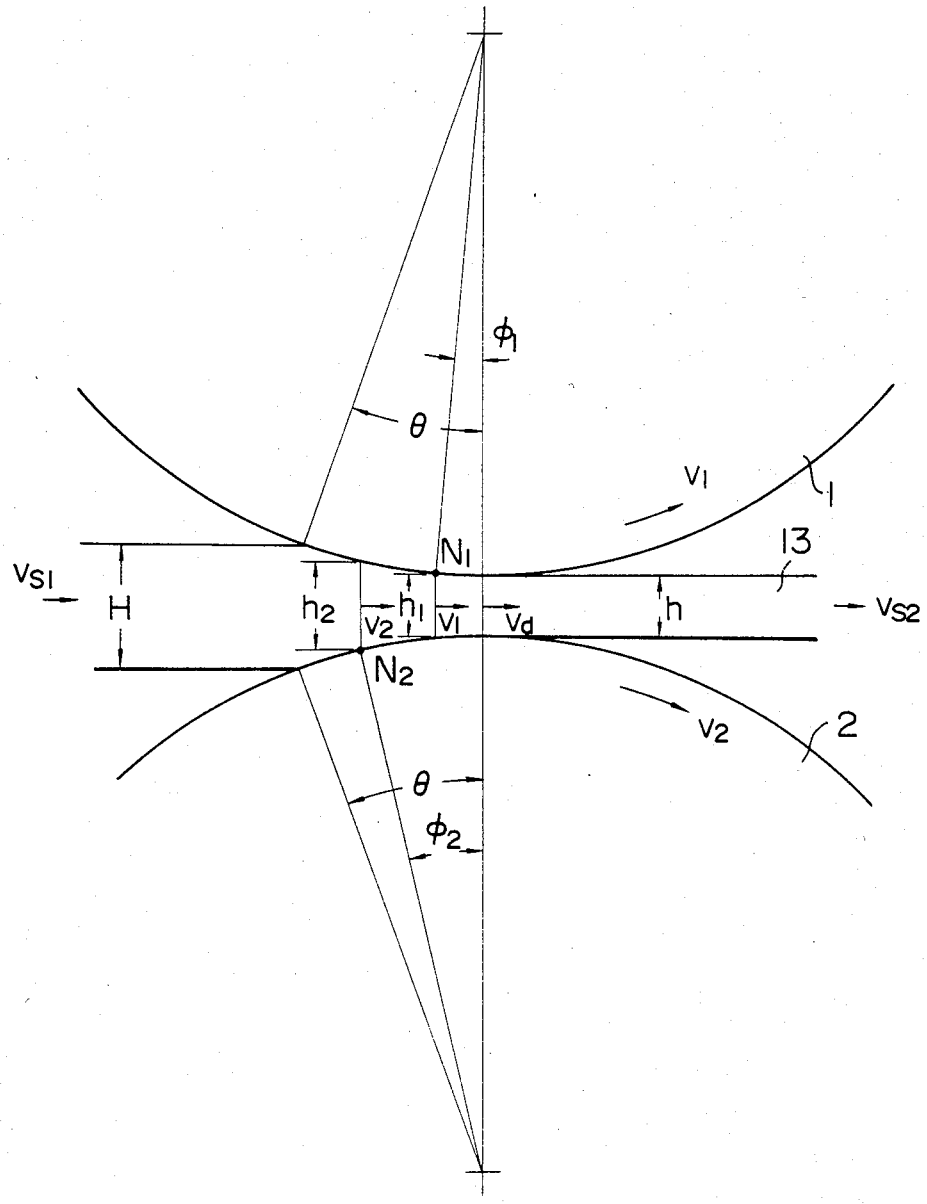
FIG. 6 illustrates how the RD effect can be exhibited according to the present invention.

P: rolling pressure $\mu$: coefficient of friction between the work rolls and the intermediate rolls T: drive torque According to the method of rolling utilizing the RD effect described already, the neutral points $N_1$ and $N_2$ between the upper and lower work rolls 1, 2 and the metal sheet article 13 are displaced relative to each other thereby attaining the reduction of the rolling pressure. According to the above method, therefore, rolling is effect while maintaining the neutral-point angles $\phi_1$ and $\phi_2$ in FIG. 6 in a relation in which they have a predetermined angular difference relative to each other.

Under the above situation, the following relations hold:

$$h_1=h+\phi_1^2R$$

$$h_2=h+\phi_2^2R$$

$$h_1v_1=h_2v_2=hv_d$$

$$\frac{v_1}{v_2}=\frac{h_2}{h_1}=\frac{h+\phi_2^2R}{h+\phi_1^2R}$$

where $h_1$: sheet thickness at the neutral point $N_1$ of the high-speed work roll 1

$h_2$: sheet thickness at the neutral point $N_2$ of the low-speed work roll 2 h: thickness of the delivery portion of the sheet article 13

R: radius of the work rolls 1 and 2

$\phi_1$: neutral-point angle to the neutral point $N_1$ $\phi_2$: neutral-point angle to the neutral point $N_2$ Thus, maintaining constant the values of the neutral-point angles $\phi_1$ and $\phi_2$ is equivalent to maintaining constant the value of $v_1/v_2$ which is the ratio between the peripheral speed $v_1$ and $v_2$ of the work rolls 1 and 2, and, in the practical method of rolling utilizing the RD effect, it is required to control the upper and lower work rolls 1 and 2 so that the ratio between their peripheral speeds is maintained constant.

For the successful practice of this method, however, strict accuracies are required for the difference in diameter between the upper and lower work rolls, for the speed detectors detecting the peripheral speeds of the upper and lower work rolls, and for the speed control of the upper and lower work rolls. Further, because of the roll arrangement in which the upper and lower work rolls are driven through the intermediate rolls, there is a possibility of slippage between the work rolls and the intermediate rolls, and it is extremely difficult to control the peripheral speeds of the work rolls so as to maintain constant the ratio therebetween.

The torques $T_1$ and $T_2$ required for driving the upper and lower work rolls 1 and 2 respectively will now be computed.

$$T_1=\mu PR(\theta-2\phi_1)$$

$$T_2=\mu PR(\theta-2\phi_2)$$

$$\frac{T_1}{T_2}=\frac{\theta-2\phi_1}{\theta-2\phi_2}$$

where $\mu$: coefficient of friction

P: rolling pressure

R: roll radius

Thus, maintaining constant the values of the neutral-point angles $\phi_1$ and $\phi_2$ means maintaining constant the ratio $T_1/T_2$ between the torques of the upper and lower work rolls 1 and 2 or maintaining constant the ratio between the torques of the upper and lower intermediate rolls 3 and 4 driving the upper and lower work rolls 1 and 2 respectively. The desired method of rolling utilizing the RD effect can also be realized by such a manner of torque control.

Therefore, slippage between the intermediate rolls and the work rolls driven through the intermediate rolls can be prevented, and also large torques can be utilized by driving the intermediate rolls having the diameter larger than that of the work rolls, so that the effect of rolling a metal sheet article between the work rolls driven at different peripheral speed, which effect has been limited by the strength of the drive system, can be liberated from such a limitation.

Figure 7:
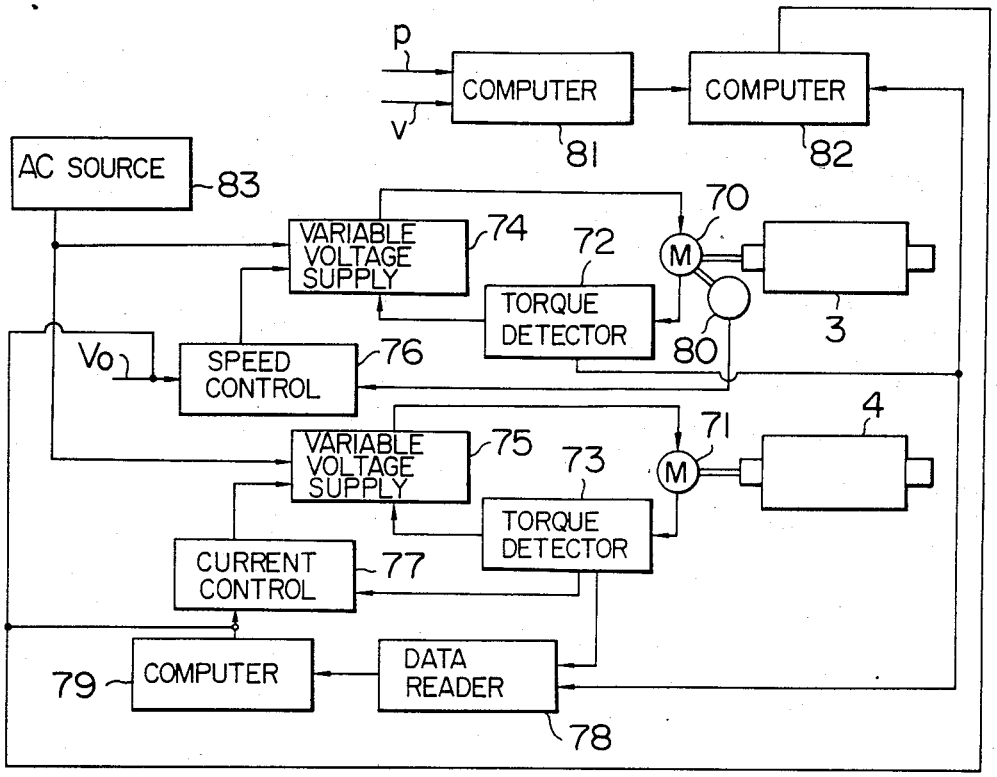
FIG. 7 is a block diagram of a control system controlling the intermediate roll drive units employed in the embodiment of the present invention.

FIG. 7 shows one form of the control system provided according to the present invention for controlling the intermediate roll drive units so as to provide a predetermined difference between the torques of the intermediate rolls 3 and 4 for driving the work rolls 1 and 2 at different peripheral speeds.

Referring to FIG. 7, the upper and lower intermediate rolls 3 and 4 are coupled to the drive motors 70 and 71 through the spindles respectively. The drive motors 70 and 71 are connected respectively to variable-voltage power supplies 74 and 75 which are supplied from a 3-phase AC power source 83.

An automatic speed control unit 76 is connected to the variable-voltage power supply 74 supplying power to the drive motor 70 for driving the upper intermediate roll 3, and an automatic current control unit 77 is connected to the variable-voltage power supply 75 supplying power to the drive motor 71 for driving the lower intermediate roll 4.

Drive torque detectors 72 and 73 are provided in the armature circuits of the drive motors 70 and 71 for detecting the armature currents proportional to the drive torques of the upper and lower intermediate rolls 3 and 4 respectively. The output signals from these drive torque detectors 72 and 73 are applied to an input data reader 78 which has the function of comparison and computation. The output signal from the drive torque detector 73 provided in the armature circuit of the drive motor 71 driving the lower intermediate roll 4 is also applied to the automatic current control unit 77.

A speed detector 80 such as a tachogenerator is provided on the shaft of the drive motor 70 driving the upper intermediate roll 3, and the output signal from this speed detector 80 is applied to the automatic speed control unit 76.

A computer 79 is connected at its input to the output of the input data reader 78 and at its output to the input of the automatic current control unit 77.

A control limit computer 82 receives an input signal indicative of the torque value $I_M$ applied from a computer 81 computing the allowable maximum torque applied to the upper intermediate roll 3 and receives also an input signal indicative of the torque value $I_f$ applied from the drive torque detector 72 associated with the upper intermediate roll 3. In response to these input signals, the control limit computer 82 applies a command signal to the automatic speed control unit 76 associated with the upper intermediate roll 3 and to the automatic current control unit 77 associated with the lower intermediate roll 4, so that the torque $I_A$ required for preventing inter-roll slippage satisfies the relation $I_A=I_M-I_f>0$.

In the control system having the structure above described, the rotation speed of the upper intermediate roll 3 is continuously detected by the speed detector 80, and the output signal from the speed detector 80 is fed back to the automatic speed control unit 76 to be compared with a roll speed setting $v_o$ applied to the automatic speed control unit 76. An error signal indicative of the difference between the detected roll speed and the roll speed setting $v_o$ is applied from the automatic speed control unit 76 to the variable-voltage power supply 74 so as to maintain the rotation speed of the upper intermediate roll 3 at the speed setting $v_o$.

In the meantime, the values of the drive torques of the upper and lower intermediate rolls 3 and 4 are detected as the levels of the armature currents of the drive motors 70 and 71 by the drive torque detectors 72 and 73 respectively. The output signals from these drive torque detectors 72 and 73 are applied to the input data reader 78 to be displayed thereon, and, at the same time, the signal indicative of the difference between the detector output signals is applied from the input data reader 78 to the computer 79. On the basis of the previously applied data such as those of the rolling pressure, thickness of the metal sheet article to be rolled, diameter of the work rolls, and coefficient of friction between the work rolls and the metal sheet article, and, also, on the basis of the presently applied data of the difference between the torques of the upper and lower intermediate rolls 3 and 4, the computer 79 computes the optimum value of the drive torque to be applied to the lower intermediate roll 4, and applies an output signal indicative of this optimum drive torque to the automatic current control unit 77. On the basis of the difference between the input signal applied from the computer 79 and the input signal applied from the drive torque detector 73, the automatic current control unit 77 controls the variable-voltage power supply 75 for the lower intermediate roll 4 thereby continuously regulating the armature current of the drive motor 71. In this case, the computer 79 computes the optimum drive torque so that the sum of the drive torques of the upper and lower intermediate rolls 3 and 4 becomes a minimum. In other words, the manner of control is such that the rotation of the lower intermediate roll 4 is suitably braked although the upper intermediate roll 3 is driven at the speed setting. This results naturally that the load of the drive unit driving the upper intermediate roll 3 increases in correspondence with the braking force generated in the drive unit driving the lower intermediate roll 4.

The computer 81 computes the allowable maximum torque T ($T<f(v)\cdot P$) on the basis of the detected rolling pressure P applied from the load detector (not shown) provided for the rolling mill and the rotation speed v detected by the speed detector 80. (Herein, f(v) indicates the function of the roll speed v.) The computer 81 applies its current output signal indicative of $I_M$ to the computer 82. The computer 82 compares the input signal indicative of the current value $I_M$ applied from the computer 81 with the input signal indicative of the detected actual current value $I_f$ applied from the drive torque detector 72 and applies a control signal to the automatic current control unit 77 so that the drive torque of the lower intermediate roll drive system can be controlled to satisfy the relation $\{I_A=I_M-I_f\}$ ($I_A>0$). When the value of $I_A$ approaches the relation $I_A=0$, the computer 82 applies a command signal to the automatic speed control unit 76 and to the automatic current control unit 77 so as to quickly reduce the speed and current thereby preventing slippage between the intermediate rolls and the work rolls. It is needless to mention that, during acceleration and deceleration, the drive torques are suitably regulated to meet the demand.

Figure 8A:
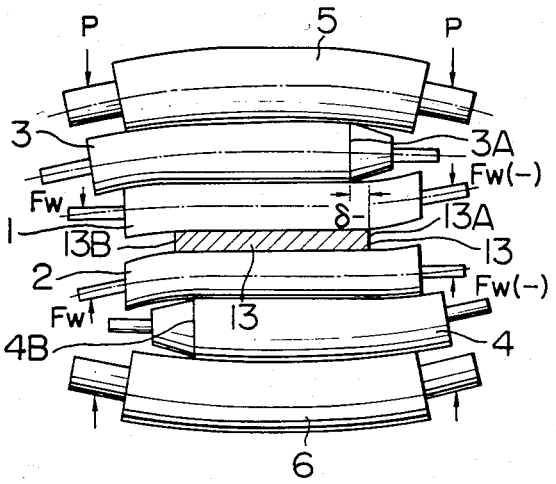
Figure 9A:
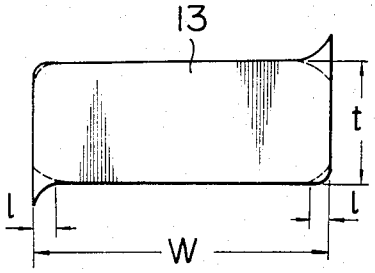

Under control of the control system shown in FIG. 7, the upper and lower work rolls 1 and 2 are driven at different peripheral speeds, and the roll shifting units 110 and 120 removably engaging the metal chocks 35 and 36 supporting the ends of the intermediate rolls 3 and 4 shown in FIG. 4 are actuated to set up a mode as shown in FIG. 8*a*. Referring to FIG. 8*a*, the relative movement of the upper and lower intermediate rolls 3 and 4 is adjusted so that one end 3A of the body of the upper intermediate roll 3 and the other end 4B of the body of the lower intermediate roll 4 are displaced by a predetermined distance δ axially inward from the widthwise ends 13A and 13B of a metal sheet article 13 respectively. Fluid under pressure is supplied to the hydraulic rams 33 and 34 shown in FIG. 4 to impart bending forces in directions in which the metal chocks 24 and 25 are urged toward each other. That is, bending forces $F_W(-)$ urging the ends of the upper and lower work rolls 1 and 2 toward each other, or the so-called decrease benders are applied so that the shape of the widthwise end portions of the sheet article 13 is transformed as shown in FIG. 9*a*. Referring to FIG. 9*a*, the sheet article 13 is transformed from the sectional shape shown by the solid lines into the sectional shape shown by the broken lines so that slight localized reductions or so-called edge waves are formed only in the widthwise edge portions l of the sheet article 13. When, for example, the width W of the sheet article 13 is 1,000 mm, the edge waves as shown by the broken lines in FIG. 9*a* are formed only in the edge portions each of which covers the distance of about 5 mm to 20 mm from the widthwise edge of the sheet article 13. The symbol t in FIG. 9*a* indicates the thickness of the sheet article 13. When the sheet article 13 is so rolled, the shape of the widthwise middle portion of the sheet article 13 is not impaired, and the slight edge waves are only formed in the very narrow regions of the widthwise edge portions of the sheet article 13. Therefore, substantially zero stretching strain is imparted to the regions l of formation of the edge waves in the sheet article 13 during rolling as shown in FIG. 10, and there is no possibility of occurrence of cracks attributable to the high tension. Undesirable breakage of the sheet article 13 at its widthwise edges can be prevented, and, therefore, a high tension can be applied to the sheet article 13 to permit rolling while driving the work rolls 1 and 2 at different peripheral speeds. The present invention is thus advantageous in that the RD effect can be fully exhibited, and a metal sheet article can be rolled in a satisfactorily stable shape under a low rolling pressure.

Figure 2:
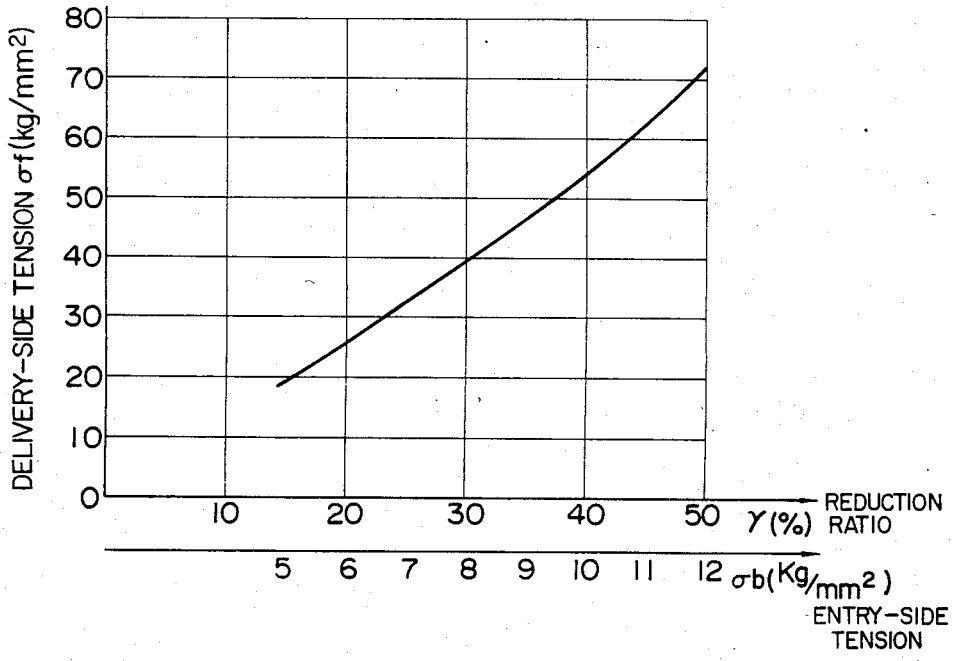
FIG. 2 is a graph showing the relation between the reduction ratio and the delivery-side tension required for rolling utilizing the RD effect.

Thus, even when a high reduction ratio of about 50% is employed for exhibition of the greatest effect of RD rolling and the delivery-side tension applied to a metal sheet article 13 may be as high as about 70 kg/mm$^2$ as shown in FIG. 2, it will be apparent from the stretching strain distribution f shown in FIG. 10 that any substantial stretching strain is not imparted to the widthwise edge regions l of the sheet article 13 having the slight edge waves formed therein, and application of a high stretching strain f, which will exceed the value $f_o$ (shown by the broken line) tending to normally produce cracks would not produce cracks in the regions l so that undesirable breakage of the sheet article 13 can be prevented. Therefore, rolling of a metal sheet article 13 under rotation of the work rolls 1 and 2 at different peripheral speeds while applying a large tension to the sheet article 13 can be achieved to fully exhibit the RD effect by which the sheet article 13 can be satisfactorily stably rolled under a low rolling pressure.

Figure 8B:
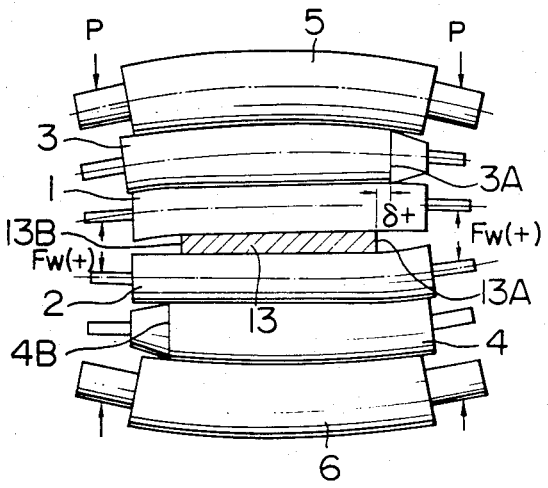
Figure 9B:
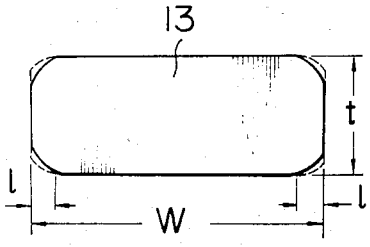

As another mode, the upper and lower work rolls 1 and 2 are similarly driven at different peripheral speeds, and the roll shifting units 110 and 120 are similarly actuated to set up a mode as shown in FIG. 8*b*. Referring to FIG. 8*b*, the relative movement of the upper and lower intermediate rolls 3 and 4 is adjusted so that one end 3A of the body of the upper intermediate roll 3 and the other end 4B of the lower intermediate roll 4 are displaced by a predetermined distance δ axially outward from the widthwise ends 13A and 13B of a metal sheet article 13 respectively. Fluid under pressure is supplied to the hydraulic rams 31 and 32 shown in FIG. 4 to impart bending forces in directions in which the metal chocks 24 and 25 are urged away from each other. That is, bending forces $F_W(+)$ urging the ends of the upper and lower work rolls 1 and 2 of small diameter away from each other, or the so-called increase benders are applied so that the shape of the widthwise edge portions of the sheet article 13 is transformed as shown in FIG. 9*b*. Referring to FIG. 9*b*, the sheet article 13 is transformed from the sectional shape shown by the solid lines into that shown by the broken lines so that localized reduction or slight edge waves are formed only in the widthwise edge regions l of the sheet article 13. Because of the formation of such edge waves, any substantial stretching strain is not imparted to these regions l, and occurrence of breakage of the sheet article 13 can be prevented. Further, in the case of the mode shown in FIG. 8*b*, the ends of the bodies of the intermediate rolls 3 and 4 are displaced axially outward by δ from the corresponding widthwise edges of the sheet article 13. Therefore, even when roll marks by the body ends of the intermediate rolls 3 and 4 may be transferred onto the work rolls 1 and 2, such marks are prevented from being transferred onto the sheet article 13.

Figure 8C:
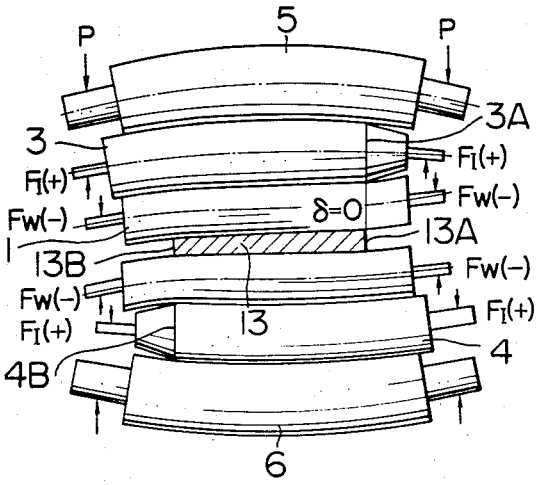
Figure 9C:
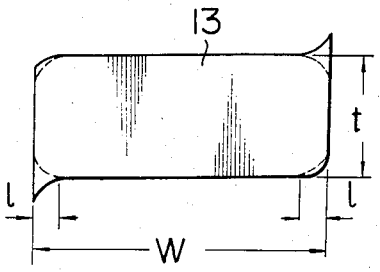

As still another mode, the upper and lower work rolls 1 and 2 are similarly driven at different peripheral speeds, and the roll shifting units 110 and 120 are similarly actuated to set up a mode as shown in FIG. 8*c*. Referring to FIG. 8*c*, the relative movement of the upper and lower intermediate rolls 3 and 4 is adjusted so that one end 3A of the body of the upper intermediate roll 3 and the other end 4B of the body of the lower intermediate roll 4 are situated substantially on the vertical lines including the widthwise ends 13A and 13B of a metal sheet article 13 respectively. That is, the axial shift δ is zero in this case. Fluid under pressure is supplied to the roll bending units including the hydraulic rams 33, 34 and 39, 40 disposed adjacent to the ends of the upper and lower work rolls 1, 2 and upper and lower intermediate rolls 3, 4 respectively shown in FIG. 4, so that bending forces $F_I(+)$ or so-called increase benders are imparted in directions in which the ends of the upper and lower intermediate rolls 3 and 4 are urged away from each other, while bending forces $F_W(-)$ or so-called decrease benders are imparted in directions in which the ends of the upper and lower work rolls 1 and 2 are urged toward each other. By so rolling, the sheet article 13 can be rolled into the shape in which localized slight edge waves are formed only in the widthwise edge regions l, as shown in FIG. 9*c*, without impairing the shape of the widthwise middle portion thereof.

Thus, in the case of the mode shown in FIG. 8*c*, the increase benders $F_I(+)$ are imparted to the upper and lower intermediate rolls 3 and 4 for the purpose of reducing the bending or deflection of these intermediate rolls 3 and 4 caused by the back-up rolls 5 and 6. The increase benders $F_I$ (+) imparted to the upper and lower intermediate rolls 3 and 4 and the zero shift $\sigma=0$ of these intermediate rolls coact to effect flattening of the sheet article 13 in the widthwise direction. Further, the decrease benders $F_W(-)$ imparted to the upper and lower work rolls 1 and 2 act to form slight edge waves in the widthwise edge regions l of the sheet article 13 as shown by the broken lines in FIG. 9*c*, so that any substantial stretching strain is not imparted to the regions l of the sheet article 13 thereby preventing undesirable breakage of the sheet article 13.

The mode shown in FIG. 8*c* is especially advantageous in that impartation of the increase benders to the intermediate rolls 3 and 4 can effect RD rolling which provides the product having a very flat widthwise middle portion.

Figure 8D:
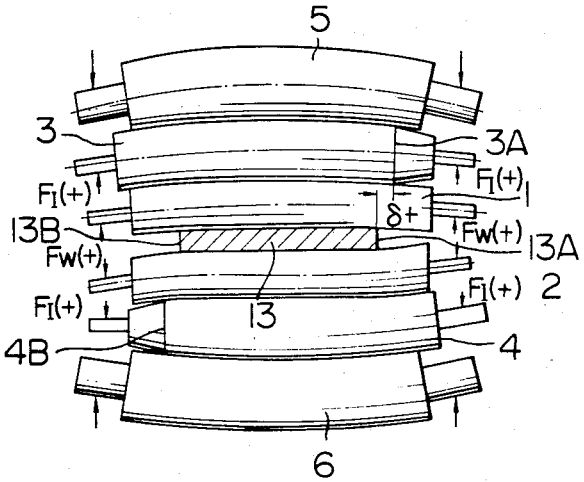
Figure 9D:
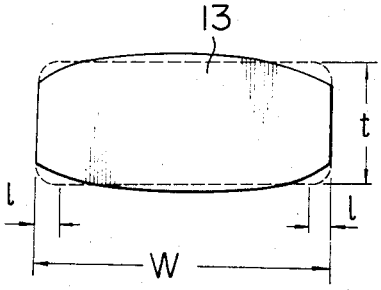

As a further mode, the upper and lower work rolls 1 and 2 are similarly driven at different peripheral speeds, and the roll shifting units 110 and 120 are similarly actuated to set up a mode as shown in FIG. 8*d*. Referring to FIG. 8*d*, the relative movement of the upper and lower intermediate rolls 3 and 4 is adjusted so that one end 3A of the body of the upper intermediate roll 3 and the other end 4B of the body of the lower intermediate roll 4 are displaced by a predetermined distance $\delta$ axially outward from the widthwise ends 13A and 13B of a metal sheet article 13 respectively. Fluid under pressure is supplied to the bending units including the hydraulic rams 39, 40 and 31, 32 disposed adjacent to the ends of the upper and lower intermediate rolls 3, 4 and upper and lower work rolls 1, 2 respectively shown in FIG. 4, so that bending forces $F_I(+)$ and $F_W(+)$ are imparted for urging the ends of the upper and lower intermediate rolls, 3, 4 and the ends of the upper and lower work rolls 1, 2 away from each other respectively. The effect thereby exhibited is similar to that exhibited by impartation of the increase benders to the intermediate rolls in FIG. 8*c*. When a metal sheet article 13 having a crown-like sectional shape meaning that the sheet thickness is maximum in the middle of the width as shown by the solid lines in FIG. 9*d* is rolled between the work rolls 1 and 2 to be flattened in the widthwise direction, edge waves tend to be formed not only in the widthwise edge regions l but also in the areas adjacent to the regions l. To prevent such a tendency, the increase benders are also imparted to the work rolls 1 and 2 so that the sectional shape of the sheet article 13 is modified from that shown by the solid lines to that shown by the broken lines in FIG. 9*d*, and slight edge waves are formed only in the widthwise edge regions l of the sheet article 13.

Besides the modes above described, there are various other combinations of the relative shifts of the intermediate rolls and the bending forces imparted to the work rolls and/or the intermediate rolls.

FIG. 12 illustrates various patterns of the rolled shape of metal sheet articles when the sheet articles are rolled between the work rolls driven at different peripheral speeds. The symbol f in FIG. 12 indicates the distribution of the stretching strain applied to the sheet article.

FIG. 12 shows in B and C the patterns of the rolled shape of sheet articles when the sheet articles are rolled by a conventional four-high rolling mill composed of a pair of work rolls and a pair of back-up rolls. FIG. 12 shows in D the pattern of the rolled shape of a sheet article when the sheet article is rolled by a six-high rolling mill composed of a pair of work rolls of large diameter, a pair of shiftable intermediate rolls and a pair of back-up rolls. FIG. 12 shows in A the pattern of the rolled shape of a sheet article when the sheet article is rolled by a six-high rolling mill to which the present invention is applied and which includes a pair of work rolls of small diameter, a pair of shiftable intermediate rolls, a pair of back-up rolls and a bending unit for bending the work rolls and/or the intermediate rolls.

In D of FIG. 12, the surface profile of the widthwise middle portion of the sheet article is satisfactory. However, because the widthwise end portions of the sheet article are not sufficiently stretched or waved the allowable stretching strain value is exceeded in the end portions, and cracks tend to be produced in these portions, resulting in a low resistance to breakage of the sheet article.

In C of FIG. 12, the sheet article is rolled by a conventional four-high rolling mill. Therefore, the widthwise surface profile of the sheet article is not satisfactory, and the resistance to breakage is low.

In B of FIG. 12, the resistance to breakage is high. However, the widthwise surface profile is not satisfactory because the regions, in which edge waves are formed, extend toward the widthwise middle portion of the sheet article.

In A to which the present invention is applied, slight edge waves are formed only in the widthwise edge regions of the sheet article. Since any substantial stretching strain is not imparted to these regions, the resistance to breakage is improved. Further, due to the fact that only these regions are locally stretched or waved, the surface profile of the widthwise middle portion of the sheet article is not impaired, and is quite satisfactory.

That is, in case of rolling a metal sheet article by work rolls of large diameter, the influence of work roll bending is exerted not only on the widthwise edge portions, but also on the widthwise middle portion of the sheet article due to the great rigidity of the work rolls, resulting in impairment of the shape of the sheet article. Therefore, it is difficult to roll a metal sheet article so as to produce slight edge waves locally at the widthwise edge portions by using work rolls of large diameter.

FIGS. 13*a* and 13*b* show the widthwise surface profiles of metal sheet articles when rolled between work rolls of large diameter and small diameter respectively in a six-high rolling mill while varying the roll bending force.

In the case of FIG. 13*a*, the roll bending force $F_W$ is imparted to the work rolls of large diameter. It will be apparent from FIG. 13*a* that the bending effect is exerted not only on the widthwise edge regions of the sheet article but also on the widthwise middle portion of the sheet article. Therefore, the shape of the rolled sheet article is not satisfactory in the case of FIG. 13*a*.

On the other hand, in the case of FIG. 13*b* in which the roll bending force $F_W$ is imparted to the work rolls of small diameter, the effect of intermediate roll shift coacts with the bending effect so that the bending effect is exerted on the widthwise end edge regions only of the sheet article and is not exerted on the widthwise middle portion of the sheet article. Therefore, the shape of the rolled sheet article is satisfactory.

The employment of small-diameter work rolls provides such an additional advantage that the rollable minimum sheet thickness can be further reduced.

The rollable minimum thickness $h_{min}$ of a sheet article, when rolled by normal rolling process using work rolls driven at the same speed is given by the following equation:

$$h_{min} = 3.58 \frac{\mu D_W \{S - (\sigma_f + \sigma_b)/2\}}{E}$$

where $\mu$: coefficient of friction between the work rolls and the sheet article $D_W$: diameter of the work rolls S: average deformation resistance of the sheet article (kg/mm$^2$)

$\sigma_f$: tension applied to the delivery side of the sheet article (kg/mm$^2$)

$\sigma_b$: tension applied to the entry side of the sheet article (kg/mm$^2$)

E: Young's modulus

Let $H_{min}$ be the minimum thickness of a sheet article that can be rolled according to the RD rolling. Then, there is the following relation between $h_{min}$ and $H_{min}$:

$$H_{min} = \alpha \cdot h_{min}$$

where $\alpha$ is the coefficient of rollable minimum thickness improvement and is a function of $(\phi_2-\phi_1)/\theta$.

The above relation is shown in FIG. 11. When a sheet article is rolled under condition of the perfect RD effect, the value of $\alpha$ is zero, which means that there is no limit in the rollable minimum sheet thickness. Usually, the rolling is carried out under a condition of $0<(\phi_2-\phi_1)/\theta<1$, so that the value of $\alpha$ varies depending on the value of $(\phi_2-\phi_1)/\theta$.

For example, when a sheet article of a low-carbon steel is rolled by conventional rolling process, the rollable minimum sheet thickness is given by $$h_{min} = \frac{3.58 \times 0.03 \times 500 \{87 - (18 + 15)/2\}}{2.1 \times 10^4}$$

$$\approx 0.18 \text{ mm}$$

assuming that the values of $\mu$, $D_W$, S, $\sigma_f$, $\sigma_b$ and E are 0.03, 500, 87, 18, 15 and $2.1\times10^4$ respectively.

On the other hand, when rolling the same sheet article by the RD rolling process under the condition of $(\phi_2-\phi_1)/\theta=0.8$, i.e. $\alpha\approx0.43$, the rollable minimum sheet thickness $H_{min}$ is given by $$H_{min}=0.43\times0.18=0.0774 \text{ mm}.$$

Further, when the work rolls having a diameter of 250 mm, which is $\frac{1}{2}$ of the diameter of 500 mm above described, are used in the rolling mill, $h_{min}$ and $H_{min}$ are given by 0.09 mm and 0.0387 mm respectively.

Suppose further that the rollable minimum sheet thickness $H_{min}$ is 0.0774 mm in the case of the rolling mill including the work rolls having the diameter $D_W$ of 250 mm. Then, the value of $\alpha$ may be $\alpha=0.0774/0.09=0.86$, and, therefore, the value of $(\phi_2-\phi_1)/\theta$ may be about 0.23. This value of $(\phi_2-\phi_1)/\theta$ is close to the value of that in a rolling mill adapted for normal rolling.

Thus, when the method of rolling does not resort to the perfect RD effect, or, in other words, when the relation $0\leqq(\phi_2-\phi_1)/\theta<1$ holds, there is the rollable minimum sheet thickness, and the smaller the work roll diameter, the rollable minimum sheet thickness becomes smaller.

Describing from the converse aspect, the reduction in the diameter of the work rolls shifts the value of $(\phi_2-\phi_1)/\theta$ from $(\phi_2-\phi_1)/\theta=1$, which corresponds to rolling with the perfect RD effect tending to cause chattering, to a value close to $(\phi_2-\phi_1)\theta=0$ which corresponds to the normal rolling, so that rolling of a sheet article between the work rolls can be stably effected.

It will be understood from the foregoing detailed description that, according to the rolling mill of the present invention which includes work rolls of small diameter and shifting units for shifting intermediate rolls engaging the work rolls of small diameter, a large tension can be applied to a metal sheet article while forming shift edge waves only in the widthwise edge regions of the sheet article, and the employment of the work rolls of small diameter can reduce the rollable minimum sheet thickness. Therefore, the value of $(\phi_2-\phi_1)/\theta$ can be shifted from the zone tending to induce chattering to the zone permitting stable rolling so that the RD effect can be fully exhibited. That is, by suitably selecting the work roll diameter and the RD effect, a metal sheet article can be stably rolled to a thickness smaller than the rollable thickness limit of normal rolling by virtue of the RD effect.

It will be appreciated that a metal sheet article can be stably rolled breakage-free and without impairment of its shape under application of a low rolling pressure according to the present invention utilizing the RD effect.

What is claimed is:

1. A method for RD rolling of sheet metal with a mill having a pair of working rolls, at least a pair of back-up rolls, and at least a pair of intermediate rolls, comprising the steps of:

continuously passing sheet metal between the working rolls while maintaining a gap between the working rolls to effect a reduction in sheet metal thickness;

simultaneously tensioning the sheet metal as it passes through the working rolls and driving the working rolls at different peripheral speeds, so that the upper and lower neutral points between the upper and lower work rolls and the sheet metal are displaced relative to each other a controlled amount sufficient to obtain a reduction of the rolling pressure and so that the energy for causing plastic deformation of the sheet metal is given by the difference between the tension applied to the delivery and entrance sides of the sheet metal, all to obtain a controlled RD rolling effect; and during said reduction of said sheet metal, simultaneously controllably imparting slight edge wave only in each edge portion of the sheet metal, said each edge portion being defined by the area of the strip extending inwardly from the strip edge by a distance of about 0.5 to 2% of the strip width, by controllably axially shifting of the intermediate rolls relative to the sheet metal edges, respectively, and controllably bending the opposite ends of at least one pair of the work rolls and intermediate rolls, sufficiently to correspondingly essentially eliminate tension in the sheet metal edges on the delivery side of the working rolls, so that the reduction ratio and correspondingly delivery side tension may be set desirably high without producing edge cracking and sheet breakage.

2. The method of claim 1, including providing the working rolls with a diameter greater than or equal to 0.15 times the width of the sheet metal and less than or equal to 0.30 times the width of the sheet metal, and with a rigidity sufficiently low, so that the work roll may be bent to provide the edge wave without impairment of the shape of the widthwise middle portion of the sheet metal between the edge waves.

3. The method of claim 2, wherein said step of producing a gap includes maintaining the reduction ratio greater than 20%.

4. The method of claim 2, wherein said step of producing a gap includes maintaining the reduction ratio greater than 40%.

5. The method of claim 2, wherein said step of producing a gap includes maintaining the reduction ratio of about 50%.

6. The method of claim 2, wherein said step of driving the working rolls includes directly driving the intermediate rolls while maintaining a constant ratio between the torques of the work rolls that are indirectly driven by frictional contact with the driven intermediate rolls, and limiting the maximum torque so that slippage between the intermediate rolls and work rolls driven thereby can be prevented, so as to permit larger torques to be utilized in driving the intermediate rolls of diameter larger than the work rolls and thereby permit greater reduction ratios than could practically be obtained by driving the working rolls.

7. The method of claim 1, wherein said step of producing a gap includes maintaining the reduction ratio greater than 20%.

* * * * *